US006568440B1

(12) United States Patent
Engelbrecht

(10) Patent No.: US 6,568,440 B1
(45) Date of Patent: May 27, 2003

(54) ATTACHABLE OIL FUNNEL

(76) Inventor: Katherine S. Engelbrecht, P.O. Box 282, Kilbourne, IL (US) 62655

( * ) Notice: Subject to any disclaimer, the term of this patent is extended or adjusted under 35 U.S.C. 154(b) by 0 days.

(21) Appl. No.: 10/145,778

(22) Filed: May 16, 2002

(51) Int. Cl.[7] ..... B65B 39/00
(52) U.S. Cl. ..... 141/338; 141/331; 141/337
(58) Field of Search ..... 141/331, 337, 141/338; D12/197, 317; 403/108, 317, 322

(56) References Cited

U.S. PATENT DOCUMENTS 1,510,631 A * 10/1924 Nutry ..... 141/338
3,537,623 A 11/1970 Fischer
4,338,983 A 7/1982 Schoenhard
4,662,771 A * 5/1987 Roe et al. ..... 403/108
5,033,521 A * 7/1991 Martin ..... 141/337
5,195,567 A * 3/1993 Tyree, Jr. ..... 141/297
5,316,059 A 5/1994 Lahman
D398,619 S 9/1998 Yevcak
D403,642 S * 1/1999 Acord ..... D12/197

* cited by examiner

*Primary Examiner*—Timothy L. Maust
(74) *Attorney, Agent, or Firm*—Patent & Trademark Services, INC; Joseph H. McGlynn

(57) ABSTRACT

A telescoping funnel which allows a user to pour oil into an engine. The funnel features spring ball latches allowing the funnel to lock into place when it is expanded or compressed. When the funnel is not in use, the funnel compresses into a small size to fit in a vehicle.

3 Claims, 1 Drawing Sheet

ATTACHABLE OIL FUNNEL

BACKGROUND OF THE INVENTION

This invention relates, in general, to a telescoping funnel, and, in particular, to a telescoping funnel for adding oil.

DESCRIPTION OF THE PRIOR ART

In the prior art various types of funnels have been proposed. For example, U.S. Pat. No. 5,316,059 to Lahnan et al discloses an oil fill funnel with a latching cap.

U.S. Pat. No. 4,703,867 to Schoenhard discloses an oil filler funnel and cap with the cap being pivoted to the funnel.

U.S. Pat. No. 4,338,983 to Hatcher discloses an oil cap with a self contained funnel and a removable cover.

U.S. Pat. No. 3,537,623 to Fisher discloses an oil fill funnel which fits over the oil fill spout.

U.S. Design Pat. No. 398,619 to Yevak discloses a design for an oil fill funnel.

SUMMARY OF THE INVENTION

The present invention is directed to an improved device for attaching a telescoping oil fill spout to a oil fill tube on an engine. The telescoping tubes have latches to hold the tube in a closed or open position, as desired by the user. Attached to the telescoping tube is a cap to seal the top of the tube.

It is an object of the present invention to provide a new and improved system that is easy to use.

It is an object of the present invention to provide a new and improved system that is easy to attach and detach.

It is an object of the present invention to provide a new and improved system that is easy to use.

These and other objects and advantages of the present invention will be fully apparent from the following description, when taken in connection with the annexed drawings.

DESCRIPTION OF THE PREFERRED EMBODIMENT

Changing the oil in a motor vehicle is a time consuming and, often, messy process. This process involves, at times, placing a bucket underneath the oil drain plug, removing the oil drain plug and filter, and waiting for the oil to drain from the engine of the motor vehicle. When the oil has substantially drained from the engine of the motor vehicle, the user tightens the oil drain plug and oil filter. Next, the user removes the oil cap from the engine. Typically, the oil cap is attached to either the top of the engine or an oil fill spout and if the oil cap is attached to the engine, it is difficult to remove due to the engine's heat and vibrations. Next, the user pours oil in the opening that was once covered by the oil cap and the user must take great care to not spill oil on the engine. This process can be either time consuming since the user does not wish to spill oil on the engine or, if the user is not careful, the process can be extremely messy since oil may spill on the engine.

In order to avoid this problem, the present invention is designed to replace a conventional oil cap that is placed either on the engine or on an oil fill spout. The present invention features telescoping tubes having latches that hold the tubes in a closed or open position. Attached to the top of the telescoping tubes is a cap for sealing the top of the tubes.

Figure 1:
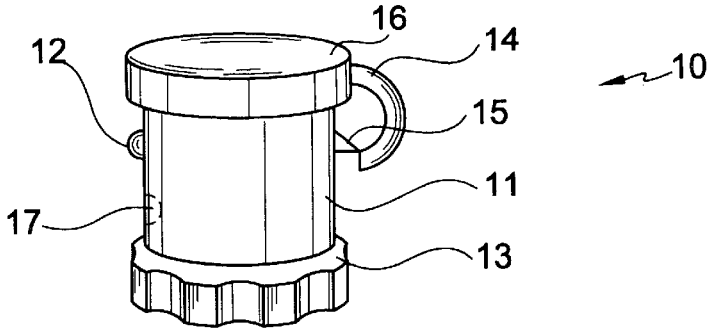
FIG. 1 is a perspective view of the present invention.

Referring now to the drawings in greater detail, FIG. 1 shows the present invention 10 having telescoping tube 11, conventional spring loaded ball latch 12, lower cap 13, spring clip 14, latch 15, and oil cap 16. It should be noted that the present invention, as shown in FIG. 1, is merely for illustration purposes only and should not be considered the only shape, or form, the present invention could take. For example, the present invention 10 is shown as being substantially cylindrical, however the present invention may be in the shape of a rectangle, square, or any shape known within the art. The present invention 10 may be constructed out of metal or heat resistant plastic.

Figure 2:
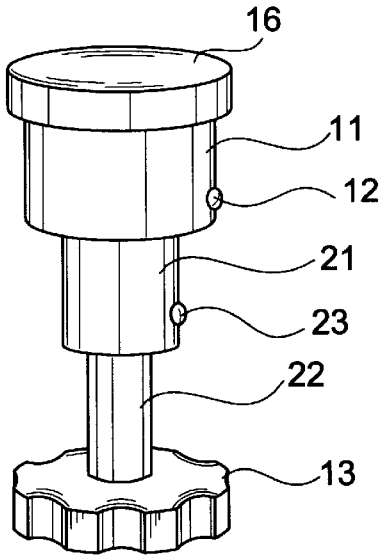
FIG. 2 is a perspective view of the present invention in the expanded position.

Telescoping tube 11 has at least one additional cylinder 21 (see FIG. 2) contained within tube 11 wherein each cylinder is slightly larger than the next. It should be appreciated that, as shown in FIG. 1, the telescoping tube 11 is shown compacted or in its closed position. When the telescoping tube 11 is expanded, as shown in FIG. 2, each cylinder forms a watertight seal with the other cylinders and would look like a funnel.

Telescoping tube 11 also features at least one ball latch 12 which holds each cylinder of the telescoping tube 11 in place when the cylinders are in the open or closed position. For example, at least one ball latch 12 on telescoping tube 11 prevents the present invention 10 from expanding. Similarly, when the user expands the telescoping tube 11, as shown in FIG. 2, the ball latch 12 on telescoping tube 11 prevents the telescoping tube 11 from collapsing onto tube 21. In order to accommodate the ball latch 12, a pair of holes 17 must be placed in the sides of telescoping tube 11, one to receive the ball when the tube is in the closed position and one to receive the ball 12 when the tube is in the open position. A similar arrangement is used for each of the telescoping tubes 11, 21, 22 in the device. This structure will be explained in more detail in FIG. 3.

Lower cap 13 is similar to a conventional oil cap and the smallest cylinder 22 within telescoping tube 11 is attached to the lower cap 13. Preferably, the smallest cylinder and lower cap 13 are of unitary, i.e. one piece, construction, however other embodiments, such as a two-piece construction are within the scope of the instant invention. If lower cap 13 and the smallest cylinder are of two-piece construction, those pieces may be attached by a threading means, snap connection, or any connection known within the art. Lower cap 13 has a substantially circular hole cut in it (not shown) in the center of lower cap 13 to receive the tube 22. Additionally, one of ordinary skill would appreciate that the hole cut within lower cap 13 has a diameter that is similar to the diameter of the smallest cylinder attached to lower cap 13. Lower cap 13 attaches to the engine or oil fill spout by means well known within the art such as, but not limited to, a threading means.

In order to attach lower cap 13 to the engine or oil fill spout, a user applies a clockwise rotation in order to fasten the lower cap 13 to the engine or oil fill spout. In an alternative embodiment, lower cap 13 might be attached to the engine or oil fill spout by means of a snap connection.

Attached to the top of the telescoping tube 11 is oil cap 16 by means of a conventional hinge (not shown). Oil cap 16 has a diameter similar to the diameter of telescoping tube 11 and when attached to the telescoping tube 11 in its collapsed state, oil cap 16 prevents oil from leaking out the top of the telescoping tube 11. Attached to oil cap 16 is clip 14, which is substantially rounded. The bottom half of clip 14 snaps over the latch 15 in order to hold the cap 16 to the tube 11. Latch 15 is spring loaded, therefore, when a user desires to open oil cap 16, the user depresses latch 15 which causes clip 14 to be released and the user opens oil cap 16. Alternatively, clip 14 could be made resilient and latch 15 substantially rigid.

In other embodiments, oil cap 16 might be attached to telescoping tube 11 by means of a snap connection, utilizing anchoring clips, or threading means. If both the lower cap 13 and oil cap 16 are attached to their respective places by a threading means, when a user desires to remove, oil cap 16, the user will apply a counter clockwise rotation to oil cap 16 to remove oil cap 16 from telescoping funnel 11. The counter clockwise rotation allows for the oil cap 16 to be removed while not removing lower cap 13.

FIG. 2 details the present invention 10 when it is in an upright, or expanded, position having telescoping funnel 11, ball latches 12 and 23, lower cap 13, oil cap 16, and cylinders 21 and 22. In order for a user to expand the present invention 10 to its current form, a user applies an upward force on the present invention 10. Since conical cylinder 22 is attached to lower cap 13 and lower cap 13 is attached to either the engine or oil fill spout, the user may do so since the present invention 10 is securely fastened. As previously stated, the diameter of telescoping funnel 11 is larger than the diameter of cylinder 21 and the diameter of cylinder 21 is larger than the diameter of cylinder 22. When the present invention 10 is expanded and in an upright position, as shown in FIG. 2, telescoping funnel 11 and cylinders 21 and 22 form a water tight seal with each other. This watertight seal ensures that no oil will leak from the present invention while a user is adding oil to the vehicle.

Additionally, in other embodiments, the present invention could feature cloth, or felt, that could be placed on top of, and around, lower cap 13 for when the present invention is collapsed and oil residue does not drip onto the uncovered lower cap 13 and into the engine compartment. This cloth, or felt, could be constructed from any material known within art and be either natural or synthetic. Additionally, since the cloth, or felt, is removable, a user can replace it with a clean cloth, or felt, when the prior cloth, or felt, becomes dirty.

Figure 3:
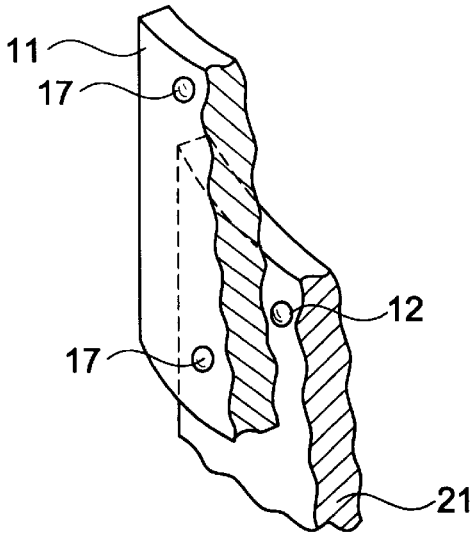
FIG. 3 is a partial view of the telescoping joint between two adjacent tubes of the present invention.

FIG. 3 details a partial sectional view of the present invention 10 having telescoping tube 11, ball latch 12, holes 17 and cylinder 21. Telescoping tube 11 slides in the same plane as cylinder 21 and as the telescoping tube 11 moves upwards, eventually the ball latch 12 will penetrate lower hole 17 causing the present invention 10 to lock into place. Upper hole 17 is placed at the top of the telescoping tube 11 so that when the present invention 10 is compressed, it will lock into place.

Although the attachable oil funnel and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim my invention is:

1. A funnel adapted to be attached to a fill spout on a vehicle, said funnel comprising:

a first member having two ends, a second member having two ends, said first member and said second member are telescoping, said first member has an internal dimension that is greater than an outside dimension of said second member, a cap, said cap is attached to a top of said first member, at least two holes in a side of said first member, at least two holes in the side of said second member, at least one latch means attached to said second member for engaging said at least two holes and holding said first and second members in an open or a closed position, and a second cap, said second cap being secured to said second member.

2. The funnel as claimed in claim 1, wherein said second cap has means for attaching said second cap to a fill aperture on a vehicle.

3. The funnel as claimed in claim 1, wherein said cap has latching means for securing said cap to said first member.

* * * * *